US005135454A

United States Patent [19]

Yeh

[11] Patent Number: 5,135,454

[45] Date of Patent: Aug. 4, 1992

[54] DUMB BELL PROVIDING SOUND REPRODUCTION

[76] Inventor: Peter Yeh, 6th Fl., No. 210; An Ho Rd., Taipei, Taiwan

[21] Appl. No.: 749,078

[22] Filed: Aug. 23, 1991

[51] Int. Cl.[5] ..... A63B 21/072

[52] U.S. Cl. ..... 482/108

[58] Field of Search ..... 272/72, 73, 75, 117, 272/116, 119, 122, 123, 129, DIG. 5, DIG. 6

[56] References Cited

U.S. PATENT DOCUMENTS

| | | | |
|---|---|---|---|
| 593,056 | 11/1897 | Maingot | 272/122 |
| 3,778,053 | 12/1973 | Smith, III et al. | 272/75 |
| 4,512,566 | 4/1985 | Bicocchi | 272/73 X |
| 4,627,618 | 12/1986 | Schwartz | 272/122 |
| 4,773,640 | 9/1988 | Kölbel et al. | 272/122 |
| 4,828,257 | 5/1989 | Dier et al. | 272/129 |

FOREIGN PATENT DOCUMENTS

| | | | |
|---|---|---|---|
| 423853 | 2/1935 | United Kingdom | 272/122 |

*Primary Examiner*—Robert Bahr

*Attorney, Agent, or Firm*—Browdy and Neimark

[57] ABSTRACT

A dumb bell comprises mainly a hand grip unit, a sound reproducing unit, and a weights unit. The hand grip unit consists of a lower case body and an upper case body, which are of hollow construction and are made of plastic material by injection molding. The lower case body is provided therein with battery mounts, circuit mounts located in one connection portion thereof and a circular tubular column located in the other connection portion thereof. The connection portions are respectively provided with thread. The sound reproducing device comprises batteries, conductive pieces mounted in the battery mounts, a sound reproducing circuit board mounted in the circuit mounts, and a speaker mounted on the circular tubular column. The sound reproducing device is capable of producing the sound of music or exercise commands. The weights unit contains two hollow plastic ball bodies of identical construction, with each ball body having a closed end and an open end with a circular hole which is provided therein with thread and a partition having a through hole disposed therethrough. The weights are placed inside the hollow plastic ball bodies.

3 Claims, 2 Drawing Sheets

DUMB BELL PROVIDING SOUND REPRODUCTION

BACKGROUND OF THE INVENTION

The present invention relates to a dumb bell used for muscular exercise, and more particularly to a dump bell equipped with sound reproducing means.

A dumb bell is a widely used sports device of simple construction with limited size. It is a device which comprises round weights joined by a short bar by which it is lifted in the hand for muscular exercise. The dumb bell as such is a rather monotonous sports device devoid of means to provide a recreational effect. Therefore, a convention dumb bell of the prior art is limited in that it often fails to encourage people, especially youngsters, to use it. The dumb bell of the present invention is provided with features capable of drawing the attention of people to take interest in using it.

SUMMARY OF THE INVENTION

It is therefore the primary objective of the present invention to provide a dumb bell comprising therein an ingenious sound reproducing device capable of producing sound of musical melodies, exercise music, or exercise commands, and the like.

It is another objective of the present invention to provide a dumb bell which is equipped with sound reproducing means and weights adjustable easily by the users, especially the youngsters.

In keeping with the principles of the present invention, the primary objective of the present invention are accomplished by the dumb bell which comprises mainly a hand grip unit, a sound reproducing device, and the weights unit. The hand grip unit is made of plastic material by injection molding and is of hollow case body consisting of an upper case body and a lower case body which are symmetrical in shape and are semi-circular externally. The upper case body and the lower case body are joined together to form a round bar, in which the circuit board, batteries, switch, and speaker of the sound reproducing device are arranged. The weights unit includes two plastic ball bodies of hollow construction and of identical shape. Each of the ball bodies is composed of a closed round end and of another end having a threaded circular hole to engage with the end of the hand grip unit. The threaded circular hole further comprises therein a partition having a through hole located at the center thereof. The weights unit further includes circular cover plates which are made of plastic material and are made to fit into the through hole of the partition. The weights are placed into the weights unit through the partition through hole. Thereafter, the through hole is capped with the cover plate. The weights unit is then ready to join with the hand grip to form a dumb bell of the present invention capable of reproducing the sound of music and the like.

The foregoing features, objectives, and advantages of the present invention will be better understood by studying the following detailed description of the preferred embodiment, in conjunction with the drawings provided herein.

DETAILED DESCRIPTION OF THE PREFERRED EMBODIMENT

Figure 1:
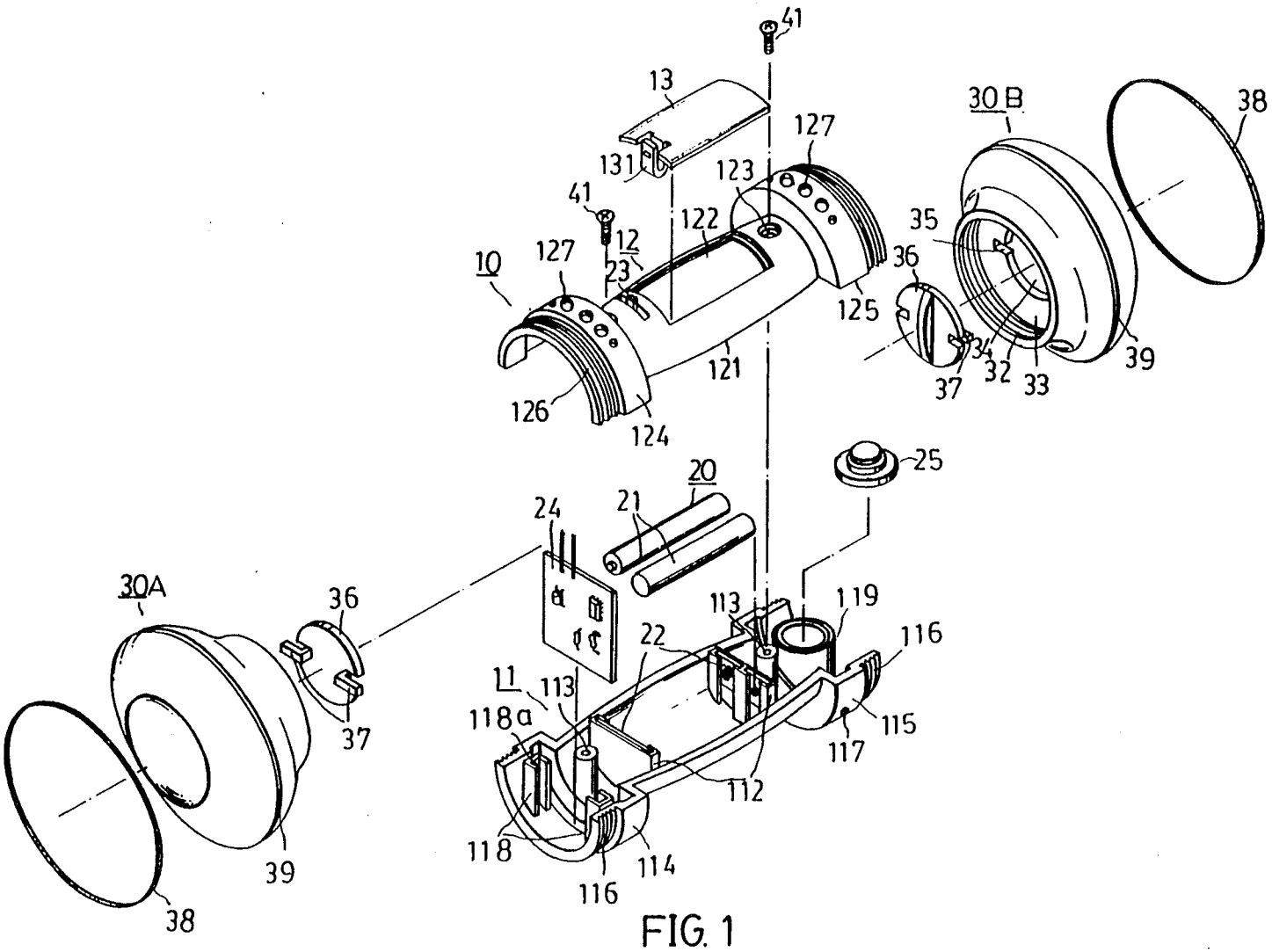
FIG. 1 shows an exploded view of the preferred embodiments of the present invention.
Figure 3:
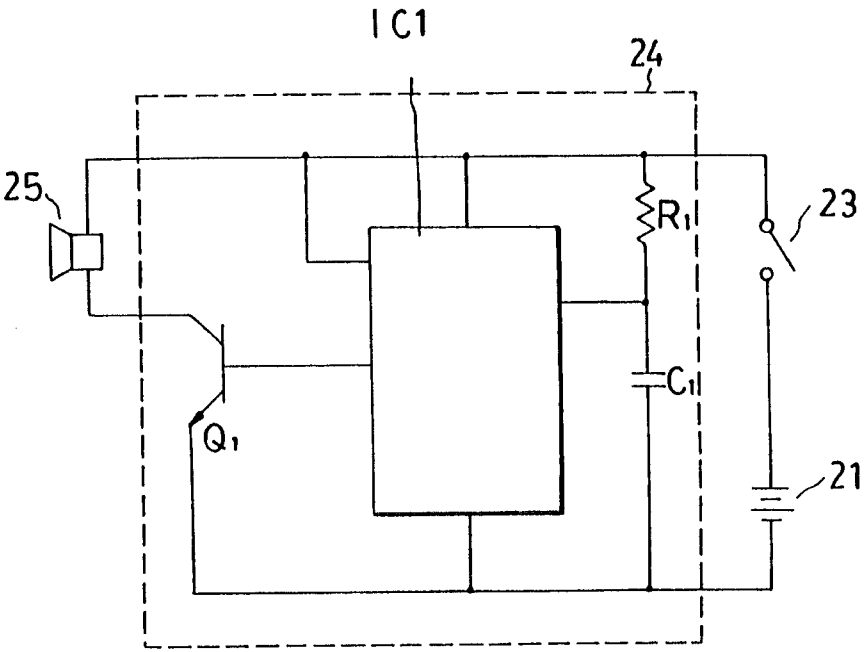
FIG. 3 shows a circuitry of the sound reproducing device of the preferred embodiment of the present invention.
Figure 2:
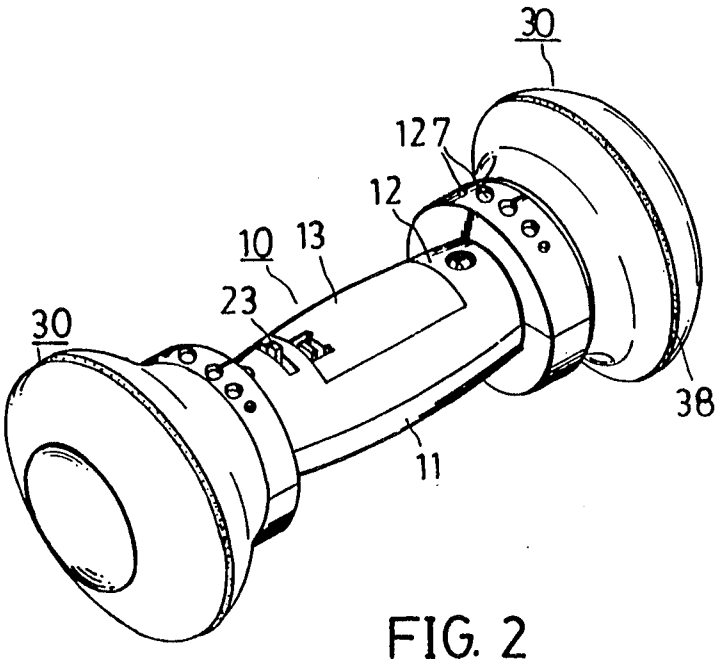
FIG. 2 shows an external three-dimensional view of a dumb ell embodied in the present invention.

Referring to FIGS. 1, 2, and 3, the dumb bell of the present invention is shown comprising a hand grip unit 10, a sound reproducing unit 20, and a weights unit 30.

The hand grip unit 10 is mainly composed of a lower case body 11, an upper case body 12, and a battery cover 13. The semi-circular lower case body 11 of hollow construction is made of plastic material by injection molding and is provided therein with battery mounts 112 and two screw-receiving columns 113. Both end portions of the lower case body 11 serve respectively as connection portions 114 and 115, with connection portion 114 being provided with male thread 116 and with connection portion 115 having therein a small circular hole 117. The connection portion 114 comprises therein an erected circuit mount 114 while the other connection portion 115 consists of a circular tubular column 119 constructed vertically therein. The upper case body 12 of hollow construction is also made of plastic material in such a manner that it is symmetrical in shapes to lower case body 11. The upper case body 12 comprises a bar portion 121 which is provided with a battery hole 122 and a round hole 123, and two connection portions 124 and 125 which are respectively provided with a male thread 126 and a small circular hole 127. The battery hole 122 of the upper case body 12 is designed to permit a battery cover 13 to fit thereinto so that the battery cover 13 is retained securely in the upper case body 12 by means of a retaining hook 131 thereof.

The sound reproducing device 20 comprises two batteries 21, a plurality of battery conductive pieces 22, a switch 23, a circuit board 24, and a speaker 25. The conductive pieces 22 are inserted into the battery mount 112. The batteries 21 are seated in the space located between the battery mounts 112. The switch 23 is attached firmly to the bar portion 121. The circuit board 24 is lodged in the slots 118*a* of the circuit board mounts 118. The speaker 25 is attached firmly to the top of the circular tubular column 119.

The weights unit 30 consists of two hollow plastic ball bodies 30A and 30B of identical construction, with each ball body having a closed end and an open end with a circular hole which is provided therein with thread 32 and a partition 33. Located in the center of the partition 33 is a through hole 34, which is provided with two indentations 35 arranged at the interval of 180 degrees along the circumference thereof. A plastic cover plate 36 of circular construction is designed to fit into the through hole 34 and is provided with two retaining hooks 37 arranged at the interval of 180 degrees so as to be able to pass through the indentations 35 to engage securely with the inner side of the partition 33. Each of ball bodies 30A and 30B further comprises a rubber ring 38 disposed in the ring groove 39 thereof.

As shown in FIG. 3, the circuit board 24 of the sound reproducing device 20 contains thereon an integrated circuit designated as IC1, which can be programmed to store music or exercise commands as desired. Through a coordination of electrical resistance R1, electrical capacity C1, and transistor Q1, the speaker 25 produces the sound of music or exercise commands stored programmably in the integrated circuit IC1, as soon as the switch 23 is turned on.

In the process of assembling the dumb bell of the present invention described above, the components of the sound reproducing device 20 such as the conductive pieces 22, the switch 23, the circuit board 24, and the speaker 25 are first arranged in the predetermined positions in upper and lower case bodies. Thereafter, upper and lower case bodies are joined together by means of screws 41 which pass through the round holes 123 to engage with the screw-receiving columns 113. The weights in the form of solid grain, or liquid, can be placed into the plastic ball bodies 30A and 30B via the through hole 34, which is then closed by the cover plate 36. The ball bodies 30A and 30B filled with weights can be connected to the hand grip unit 10 by allowing the thread 32 of ball bodies to engage with the thread 126 of the hand grip unit 10, thereby permitting upper and lower case bodies 12 and 11 to join together securely. The dumb bell so made is a light-weight sports device.

Before making use of the dumb bell of the present invention, the user may open the battery cover 13 to place the batteries 21 into the dumb bell. As soon as the switch 23 is turned on, the sound reproducing device 20 works to produce the sound of music or exercise commands, which is subsequently sent out through the small circular holes 127 of the connection portions 124 and 125. The dumb bell of the present invention serves as an ideal sports or recreational adjunct for use by children or youngsters.

The embodiment of the present invention described above is to be considered in all respects as merely an illustration of principles of the present invention. Accordingly, the present invention is to be limited only by the scope of the hereinafter appended claims.

What I claim is:

1. A dumb bell having sound reproducing means comprising:

(a) a hand grip unit consisting of a lower case body and an upper case body, which are of hollow construction and are made of plastic material by injection molding, said lower case body being provided therein with battery mounts, circuit mounts located in one connection portion thereof, and a circular tubular column located in the other connection portion thereof, said connection portions being respectively provided with thread;

(b) a sound reproducing device comprising batteries, conductive pieces mounted in said battery mounts, a sound reproducing circuit board mounted in said circuit mounts, and a speaker mounted on said circular tubular column; and (c) a weights unit containing two hollow plastic ball bodies of identical construction, with each ball body having a closed end and an open end with a circular hole which is provided therein with thread and a partition having a through hole disposed therethrough.

2. A dumb bell having sound reproducing means according to claim 1, wherein said sound reproducing circuit board comprises thereon an integrated circuit containing music stored programmably therein.

3. A dumb bell having sound reproducing means according to claim 1, wherein said through hole of partition is designed to permit a cover plate to fit thereinto, said cover plate being provided with retaining hooks facing toward the inner side of said partition.

* * * * *